US006340099B1

(12) United States Patent
Ho et al.

(10) Patent No.: US 6,340,099 B1
(45) **Date of Patent: *Jan. 22, 2002**

(54) CONTAINER WITH A STRUCTURAL IMPROVEMENT

(75) Inventors: Stanley Ho, Warren, NJ (US); Mark Ho, Taipei (TW)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/643,174

(22) Filed: Aug. 21, 2000

Related U.S. Application Data

(62) Division of application No. 09/334,806, filed on Jun. 17, 1999, now Pat. No. 6,105,819

(60) Provisional application No. 60/089,873, filed on Jun. 19, 1998.

(51) Int. Cl.[7] ..... B67D 5/60

(52) U.S. Cl. ..... 222/78; 222/131; 222/321.7; 428/13; 40/406; 40/410

(58) Field of Search ..... 222/78, 130, 131, 222/321.7, 382, 383.1, 402.1, 562; 40/406, 410; 428/13

(56) References Cited

U.S. PATENT DOCUMENTS 6,105,819 A * 8/2000 Ho et al. ..... 222/78

* cited by examiner

*Primary Examiner*—Phillipe Derakshani

(74) *Attorney, Agent, or Firm*—Frommer Lawrence & Haug LLP; Edgar H. Haug; Grace L. Pan

(57) ABSTRACT

The present invention relates to a container with a structural improvement. The improvement comprises one transparent hollow vessel, at least one circular dividing board and at least one reservoir for containing either liquid and/or solid, wherein the transparent hollow vessel has a first end and a second end, the first end further comprising a threaded sleeve, the second end of the transparent hollow vessel at an appropriate location having a water intake opening. The second end of the transparent hollow vessel is matingly-fitted with the circular dividing board, wherein the center of the circular dividing board has an opening to receive a dispensing tube, the dispensing tube positioned between the opening of the circular dividing board and the threaded sleeve of the first end of the transparent hollow vessel. The reservoir is matingly-fitted and positioned below the transparent hollow vessel. The transparent hollow vessel can contain various decorative items, various water, oil, liquids, colored or clear can be injected into the transparent hollow vessel through the water intake opening located at the second end of the transparent hollow vessels, taking advantage of the fact that the colored oil has a higher density than water, thus causing the colored oil to be positioned below the water. The various decorative items must be denser than water but less dense than the coloring agent for the various decorative items to remain afloat above the coloring agent, providing an aesthetic effect. In addition, the reservoir can contain cleansing solution such as shampoo, detergent, or lotion, and a fluid delivering tube is disposed within the dispensing tube to push the cleansing solution out of the reservoir into a user's hand through the dispensing tube. Accordingly, the present invention provides an utilitarian purpose as well as being aesthetically pleasing.

4 Claims, 15 Drawing Sheets

CONTAINER WITH A STRUCTURAL IMPROVEMENT

RELATED APPLICATION

This application is a division of Ser. No. 09/334,806 filed Jun. 17, 1999 now U.S. Pat. No. 6,105,819 which claims priority to provisional application, U.S. Ser. No. 60/089,873 filed Jun. 19, 1998.

DETAILED DESCRIPTION OF THE PRESENT INVENTION

The present invention provides a container with a structural improvement, wherein the transparent hollow body can contain various decorative items disposed within the colored and/or liquid fluid and can be stationary or floating, thus aesthetically pleasing. It can also achieve an utilitarian purpose by containing cleaning agent disposed within the reservoir.

Presently available dispensers for cleansing solution such as shampoo and/or shower gel are predominantly made from blow-molding a disposable dispenser, as shown in FIG. 1. The dispenser 7 can have a variety of shapes and sizes. It can also have a design printed on the outer surface of the container, or animals or cartoon characters on top of an actuator, to make the dispenser attractive (not shown in FIG. 1). However, although one can imprint various designs on the outside surface of dispenser 7, it is still predictable and boring and is not considered decorative. In addition, when the cleansing solution is exhausted in the dispenser, such dispenser is not reusable and since the designs were only printed on the surface of the container, the thought of using the empty dispenser 7 as a decorative item does not occur to consumers. The end result is that these dispensers will be discarded, creating a large amount of garbage which will adversely affect the environment.

Commonly available decorative items are usually a combination of colored liquid with decorative structures. One can fill a glass container with water, at the same time also inject bright-colored oil, then tightly seal the glass container to prevent the water and the bright-colored oil from leaking. Since the bright-colored oil has a higher density than water, the bright-colored oil is positioned below the water.. Because the decorative structure has a higher density than water but less density than the bright-colored oil, the decorative structure floats above the bright-colored oil. As the bright-colored oil and the water are both liquids, this causes the decorative structure to move with the liquids. Although the movement of the liquids together with the decorative structure is aesthetically pleasing, such an item is only for decoration and lacks utility. Accordingly, such commonly available decorative items, though attractive, lack utility.

An object of the present invention is to provide a novel dispenser, which is aesthetically pleasing yet functional and which does not adversely affect the environment. Accordingly, the applicant of the present invention, motivated by the aforementioned objectives, created a novel dispenser, which in addition to overcoming the shortcomings of the prior art, also provides a functionality that ultimately protects the environment.

Accordingly, the main purpose of the present invention is to provide an improved water globe container which comprises: one hollow transparent sleeve, wherein a first top edge surface has a spiral tube; one reservoir containing shower gel, shampoo or other cleansing solution, wherein a second top edge surface has a threaded member and through a base member the hollow transparent sleeve is matingly-fitted to a reservoir with a circular dividing board in between to create a tight seal. The base member has a first surface and a second surface, both the first and the second surfaces having female threaded members at the periphery and the base member having a means for defining an opening in the center of the base. The opening extends upwardly forming a sleeve and a flexible member is formed at an end of the sleeve, the flexible member having a slightly smaller diameter than the sleeve. A water intake opening is positioned between the opening and the female threaded members with the first surface of the base member having male threaded members. The interior of the hollow transparent sleeve can be decorated with various artifacts and through the water intake opening, water is introduced into the hollow transparent sleeve to give the hollow transparent sleeve a crystal-like configuration. An actuator can be installed in the hollow sleeve to withdraw the shower gel, shampoo and other cleansing solution contained within the reservoir. Thus, the present invention provides a design that is both functional and aesthetically pleasing.

The characteristics and the structure of the present invention can be understood by the detailed description provided below along with accompanying drawings in order to ensure easy understanding of the present invention.

EXPLANATION OF THE DRAWINGS

1. transparent hollow cavity

11. threaded member

Figure 1:
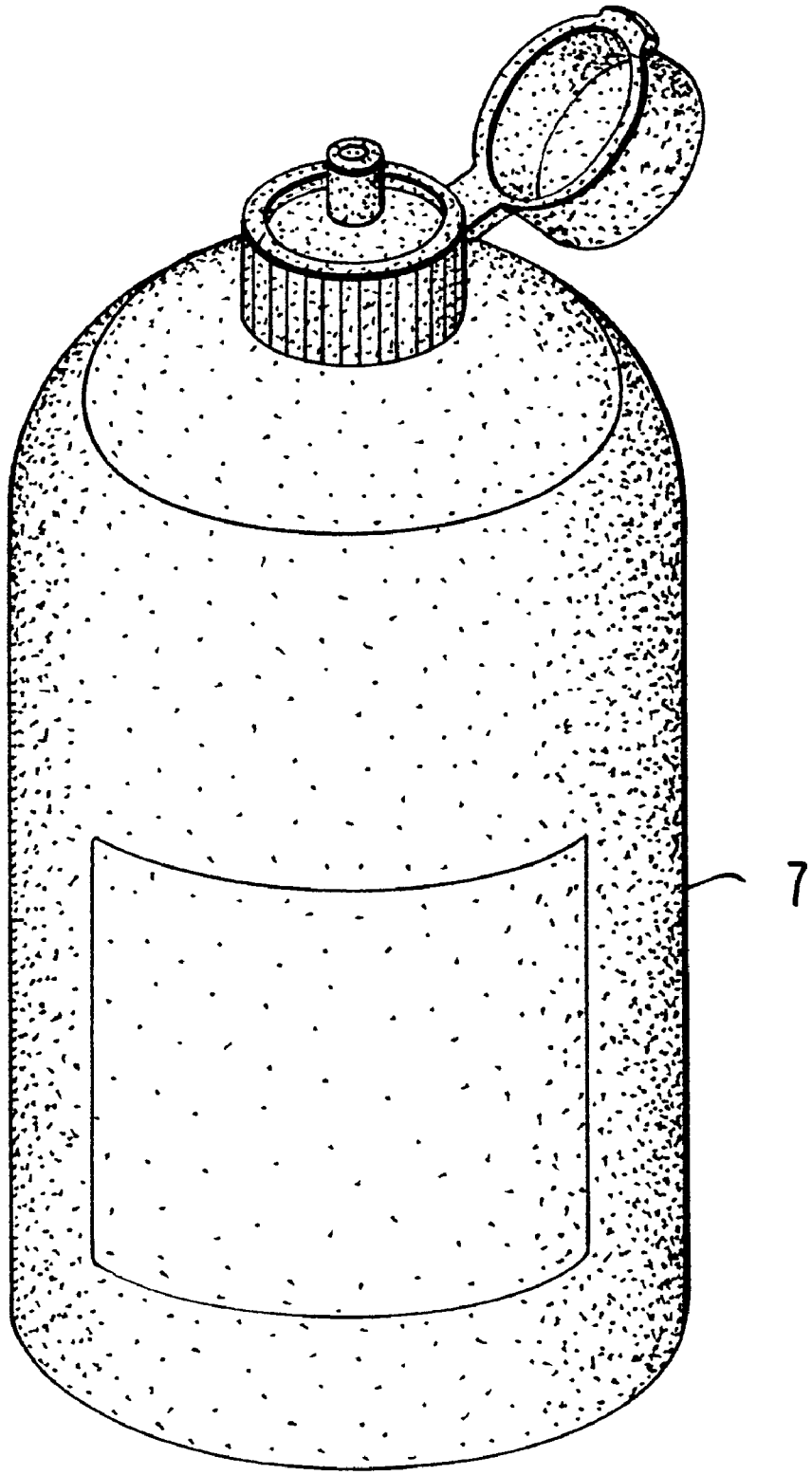
FIG. 1 is a three dimensional view of the conventional container.
Figure 2:
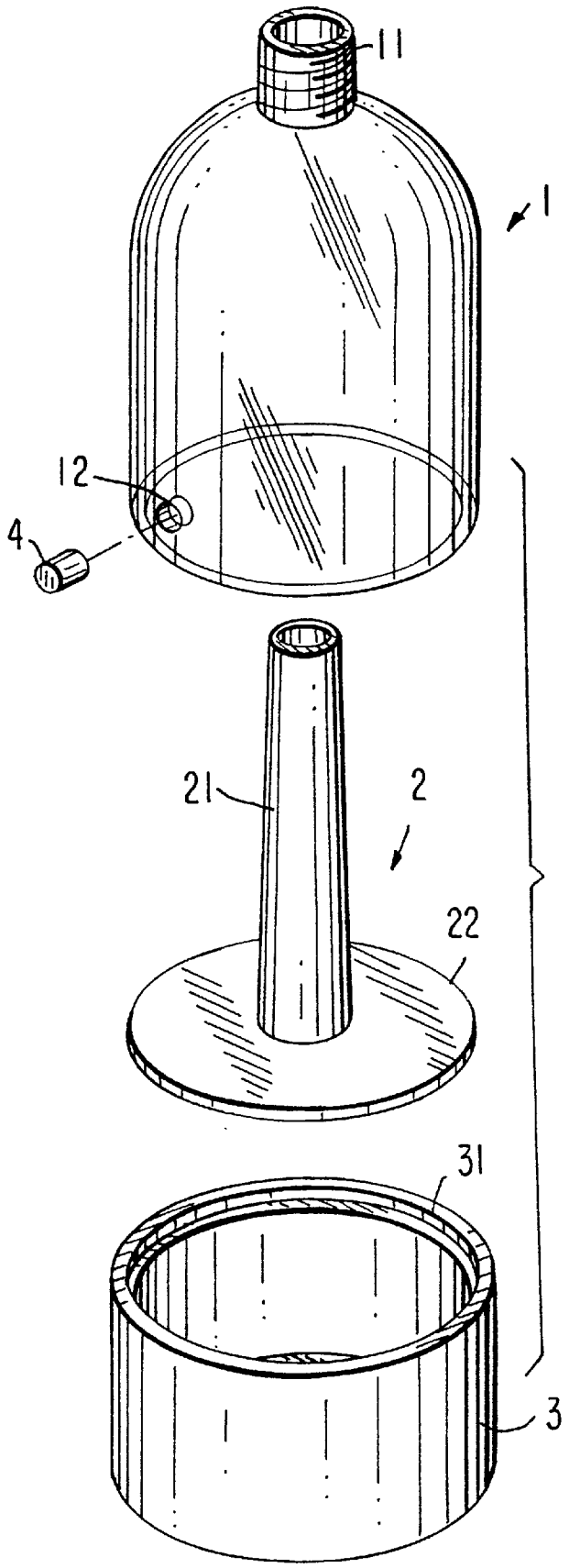
FIG. 2 is an exploded view of the various parts of the device in accordance with the present invention wherein the dispensing tube is matingly fitted on the surface of the circular dividing board.

12. water intake opening
13. tapered dispensing sleeve
2. circular dividing board
21. dispensing sleeve
22. circular disk
23. threaded opening on the circular dividing board to receive the dispensing tube
24. threaded member on an outer surface of the circular dividing board to matingly-fitted with the reservoir
3. reservoir
31. threaded member on an inner surface of the reservoir to receive and matingly-fitted with the circular dividing board.
4. stopper
5. actuator
51. dispensing tube
6. decorative item
7. conventional container
a. water
b. colored oil
c. cleansing solution Reference is made to FIG. 2, which shows an exploded view of the various components in accordance with the present invention. The dispenser according to the invention comprises: one transparent hollow cavity (1), one circular dividing board (2) having a first end and a second end and one reservoir (3), wherein the transparent hollow cavity (1) is hollow and has a first end and a second end, and a threaded member (11) positioned at the first end of the transparent hollow cavity. A water intake opening (12) is positioned toward the second end of the transparent hollow cavity (1) and the water intake opening (12) can be closed and/or sealed with a stopper (4) or any other commonly available adhesive or microwave technology. The transparent hollow cavity (1) can be made from plastic or glass or any other material that is transparent.

The circular dividing board (2) comprises a circular disk (22) fusing with the dispensing sleeve (21) via microwave, the dispensing sleeve (21) penetrating the center of the circular disk (22) which has a first end and a second end.

The reservoir (3) is dome-like and hollow which enables the reservoir to store human body cleansing lotion/solution. The reservoir (3) has an interior surface, an exterior surface, a first end and a second end, wherein the first end of the interior of the reservoir has a threaded member (31) and is designed to matingly fit with the transparent hollow cavity (1) and the first end of the circular dividing board (2).

Figure 3:
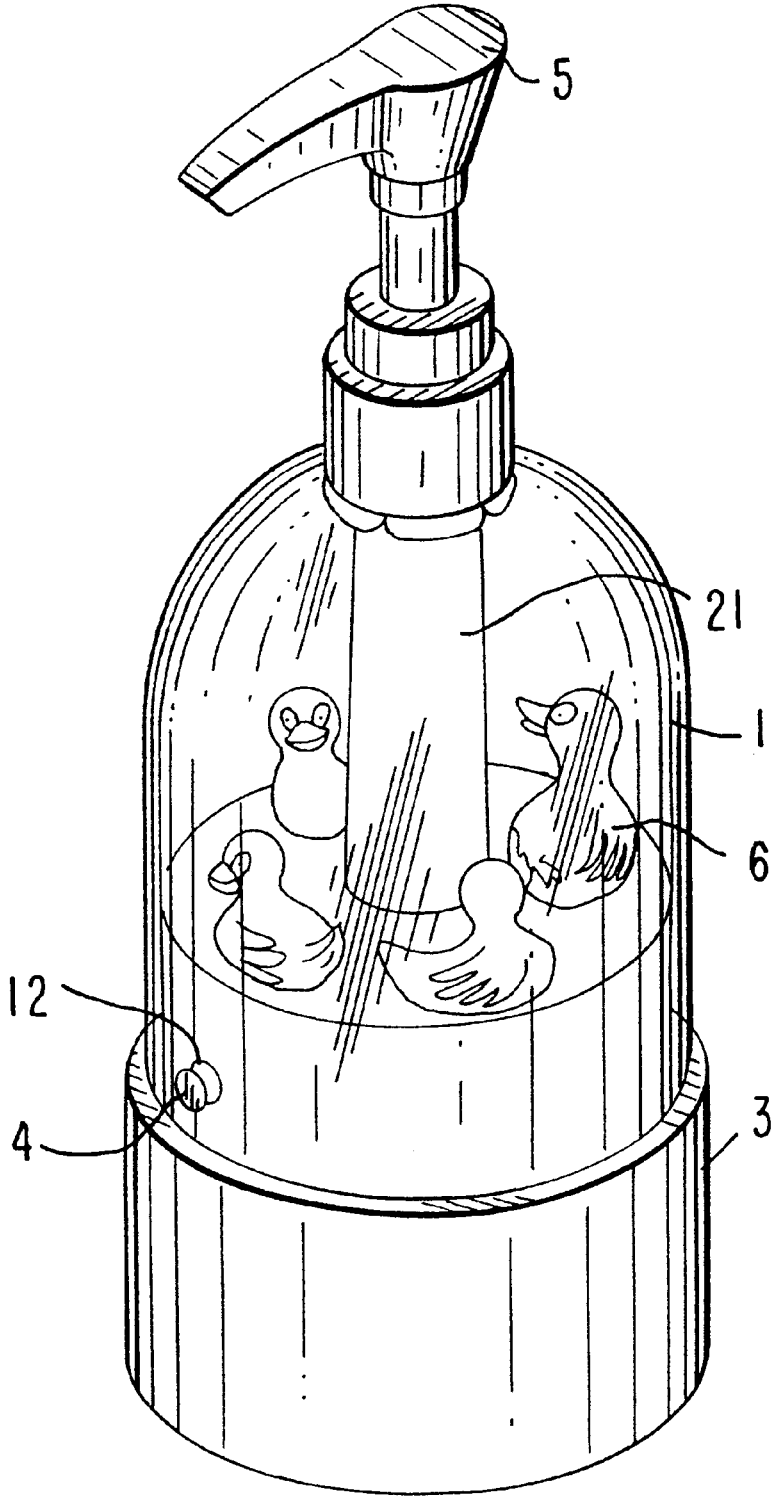
FIG. 3 is a three dimensional view of a dispenser according to the present invention.

According to the above-described structures, the construction of the present invention is made by placing the circular dividing board (2) in the interior of the transparent hollow cavity (1), thus causing the dispensing sleeve (21) to matingly fit with the threaded member (11) of the transparent hollow cavity (1). In addition, as illustrated in FIG. 3, one can first place the decorative item (6) in the transparent hollow cavity (1), use microwave adhesion to seal the first end of the circular disk (22) with the second end of the transparent hollow cavity (1), and then connect the reservoir (3) which contains the human cleansing solution/lotion with the second surface of the circular dividing board (2) which is part of the circular disk (22). Thus, the second end of the circular dividing board (2) will matingly fit with the threaded member of the inner surface of the reservoir (31) to form the construction of the present invention.

Figure 4:
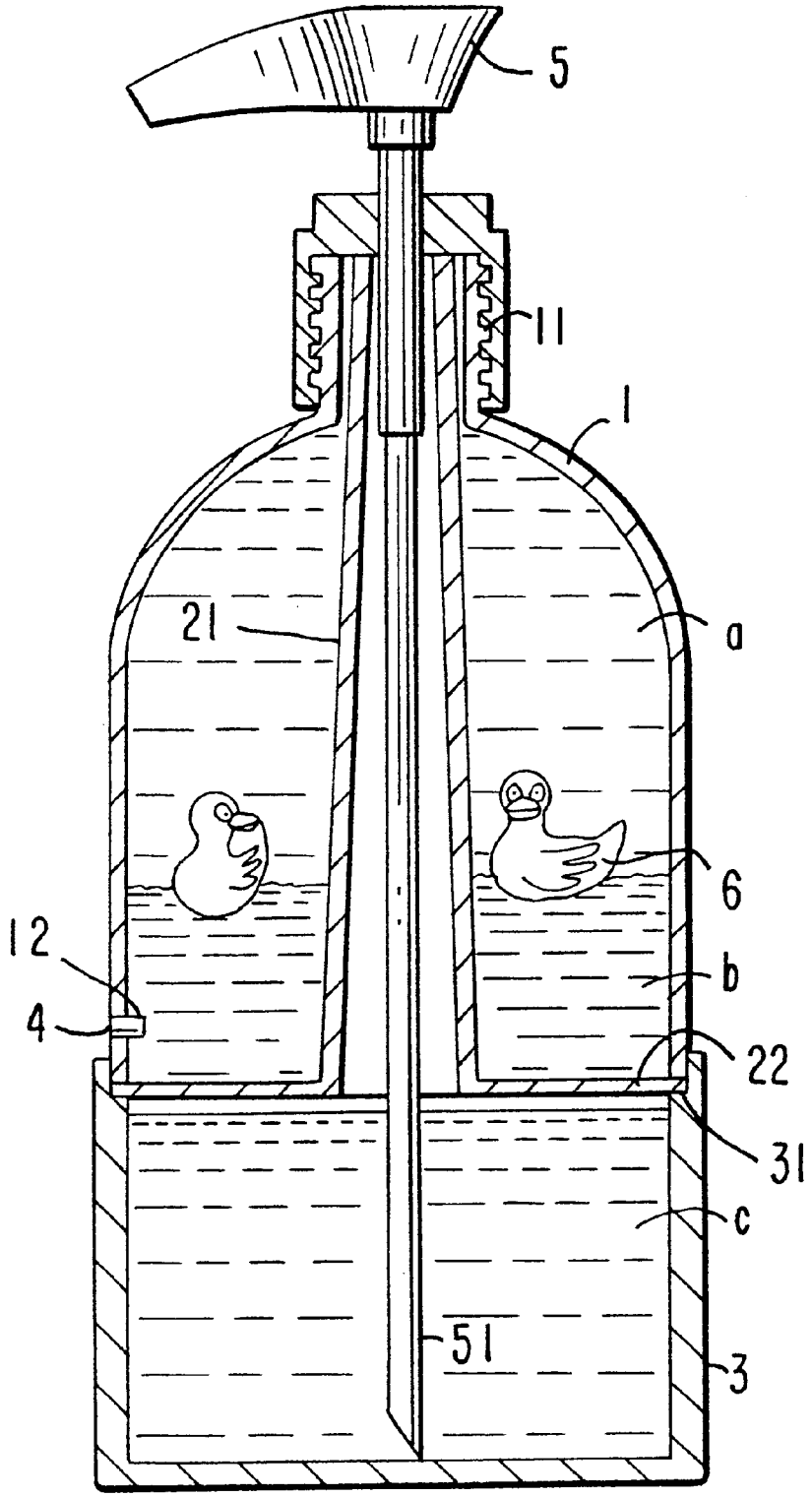
FIG. 4 is a partial sectional view of FIG. 3.

Referring to FIGS. 3 and 4, FIG. 3 shows a three dimensional view of the dispenser according to the present invention and FIG. 4 shows a partial sectional view of FIG. 3. The dispenser shown is comprised of a transparent hollow cavity (1), a water intake opening (12) positioned toward the second end of the transparent hollow cavity (1), wherein water (a) and colored oil (b) can be injected into the transparent hollow cavity (1). After liquid (a) and liquid (b) reach a certain pre-determined ratio and when the volume of liquid (a) and liquid (b) completely fill the transparent hollow cavity (1), the water intake opening (12) is sealed by a stopper (4) as shown in FIG. 2 to prevent the exiting of liquid (a) and liquid (b) from the transparent hollow cavity (1). At this time, since the density of liquid (a), namely water, is smaller than that of liquid (b), namely colored oil, liquid (a) is positioned above liquid (b), and, since the weight of the decorative item (6) is greater than liquid (a) but smaller than liquid (b) and since the interior of the transparent hollow cavity was specially treated to create a vacuum, the decorative item (6) sits atop the colored oil, namely liquid (b). When the dispenser is shaken, the decorative item (6) remains floating on top of liquid (a) which in turns floats above liquid (b). The decorative item (6) moves with the movement of the fluid, causing a scenic and aesthetically pleasing picture. In addition, an actuator (5) is positioned on top of the threaded member (11) which matingly fits with the dispensing tube (21). Thus, when an user depresses the actuator (5) which has a dispensing tube connecting the actuator and the reservoir (3), the user can retrieve the human cleansing solution (c) from the container. The present invention not only provides a utility function, the dispenser itself can also be used as a decorative item, providing hours of entertainment for watching the decorative item move with the liquids. In addition, the dispenser also can be refilled, enabling multiple use and thus decreasing the accumulation of non-biodegradable waste and improving the environment.

Figure 5:
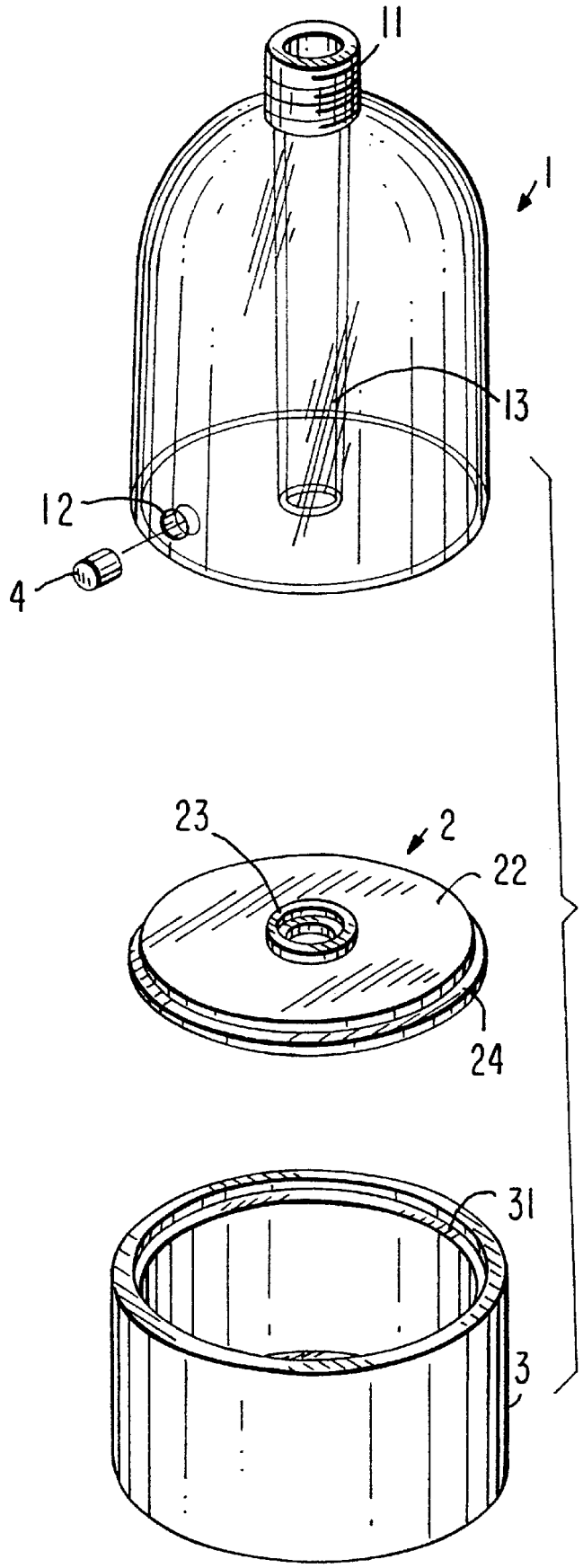
FIG. 5 is an exploded view of the various parts of the device in accordance with the present invention wherein the dispensing tube is matingly fitted on the threaded sleeve of the transparent hollow cavity.
Figure 6:
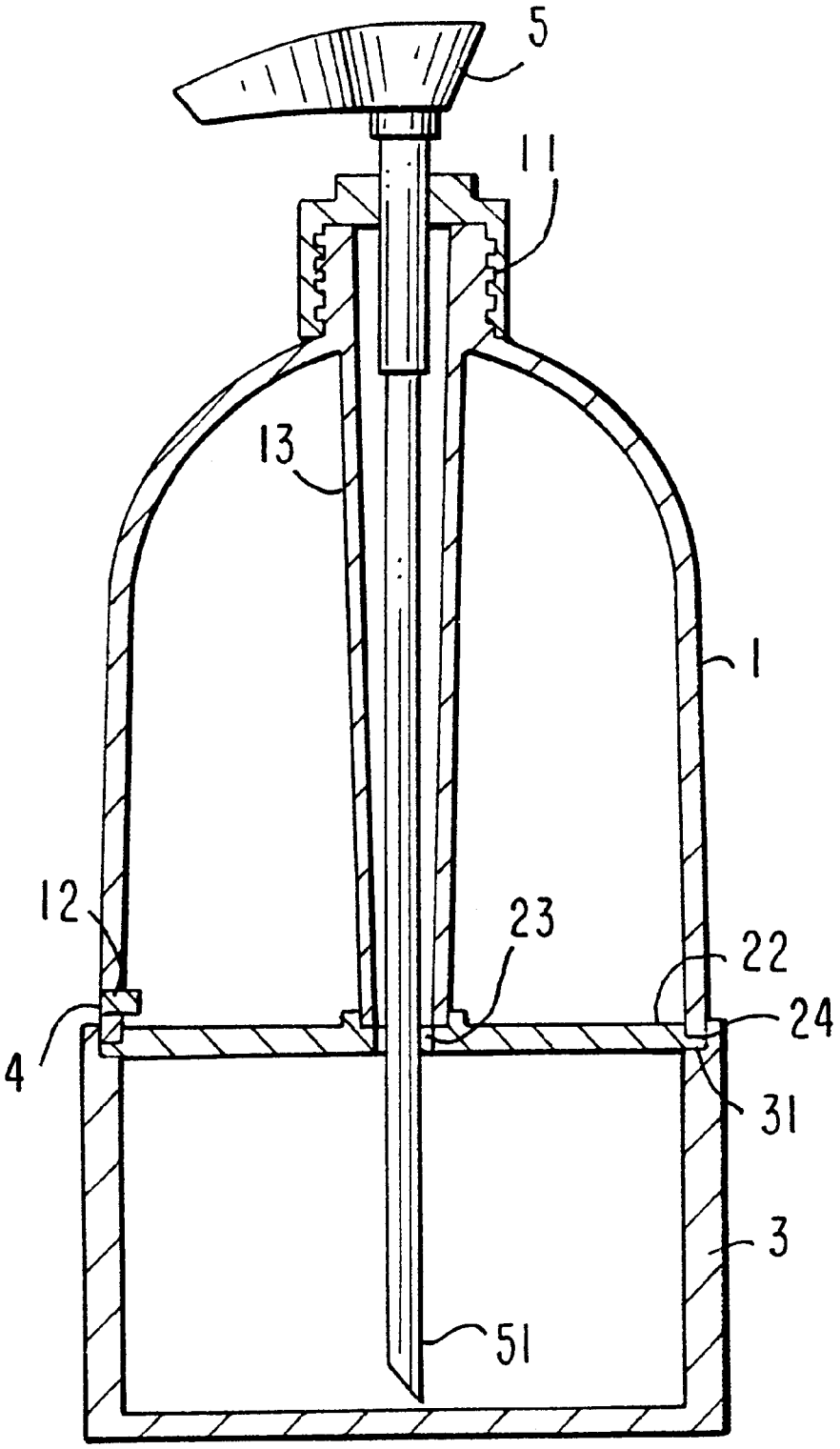
FIG. 6 is a sectional view of the device in accordance with the present invention.
Figure 7:
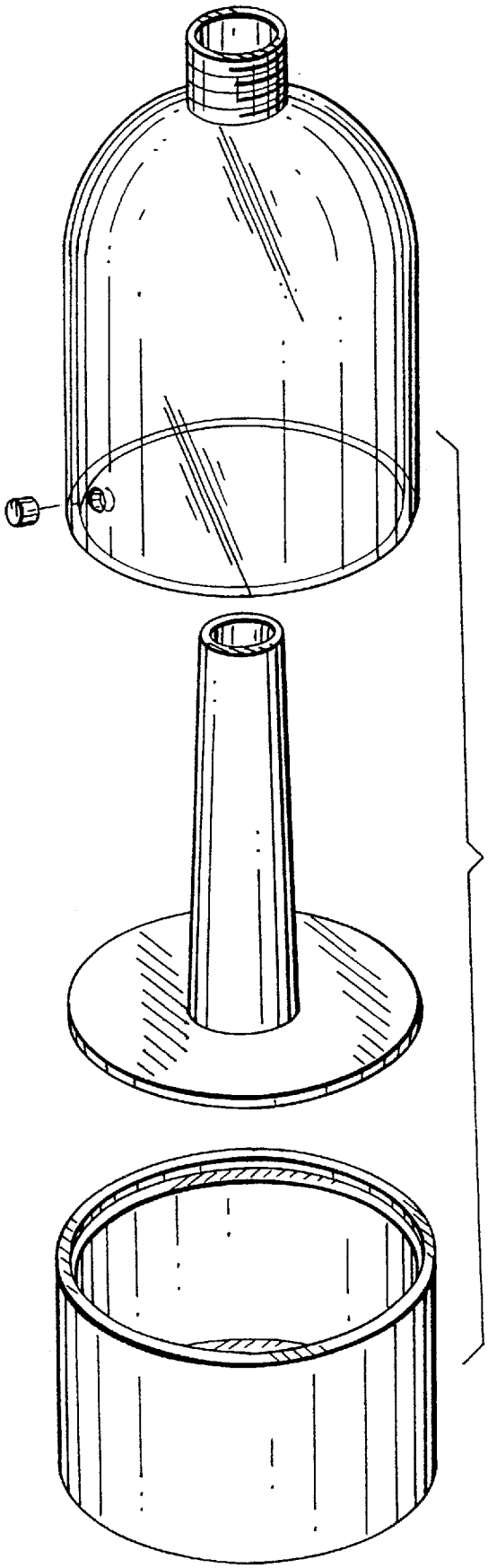
FIG. 7 is a partial sectional view of FIG. 6 wherein the various portions of the dispenser in accordance with the present invention are shown individually.
Figure 8:
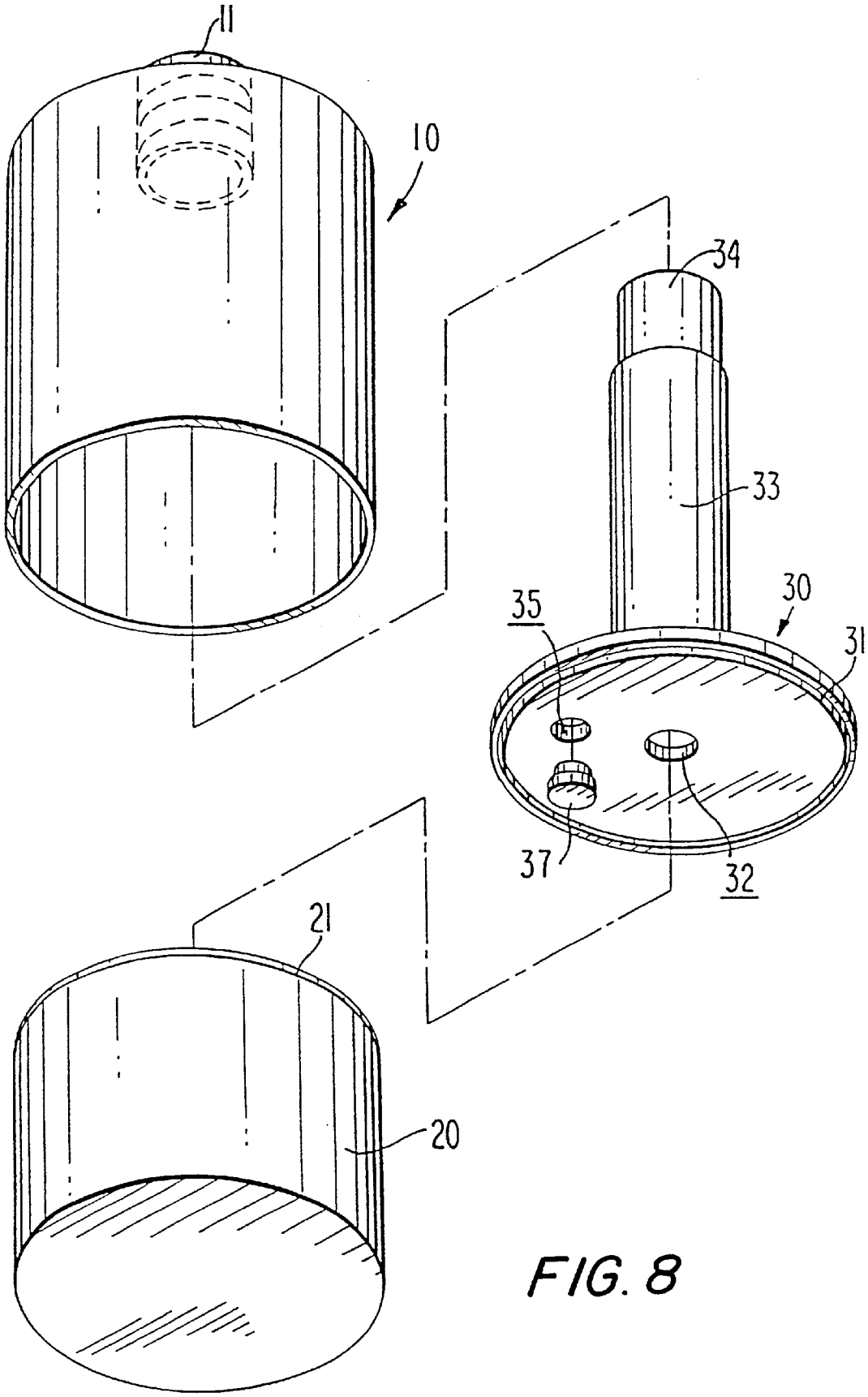
FIG. 8 is an exploded view of the device in accordance with the present invention.
Figure 9:
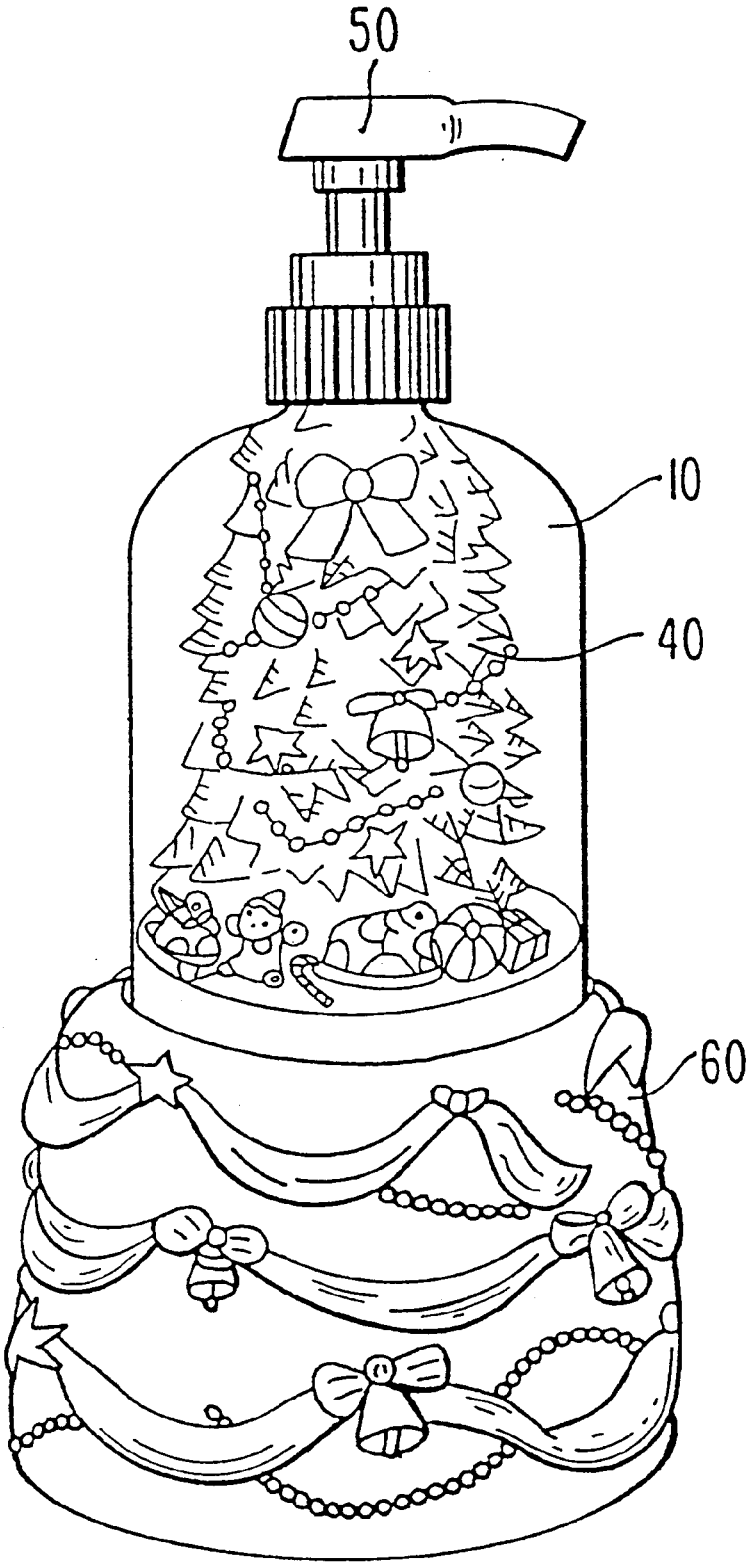
FIG. 9 is a second embodiment in accordance with the present invention.
Figure 10:
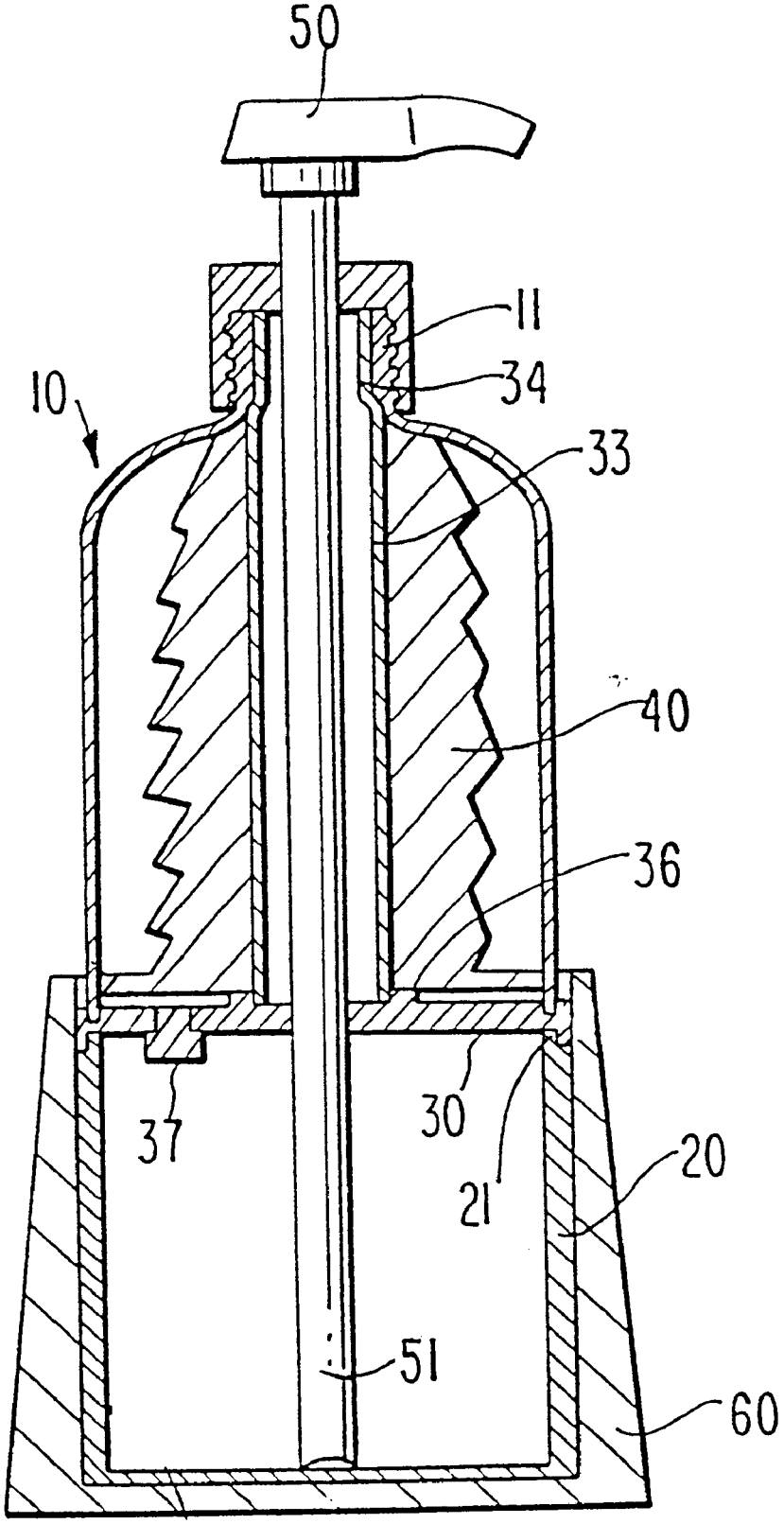
FIG. 10 is a partial sectional view of FIG. 9.
Figure 11:
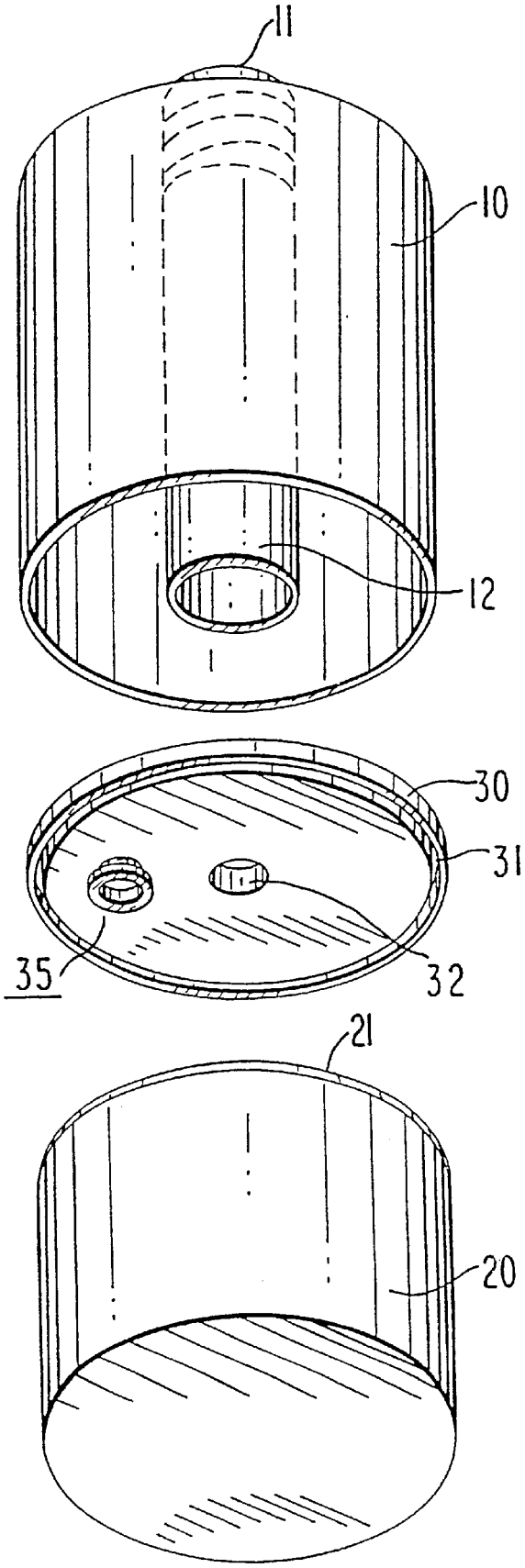
FIG. 11 is an exploded view of FIG. 9 wherein the various portions of the dispenser in accordance with the second embodiment of the present invention are shown individually.
Figure 12:
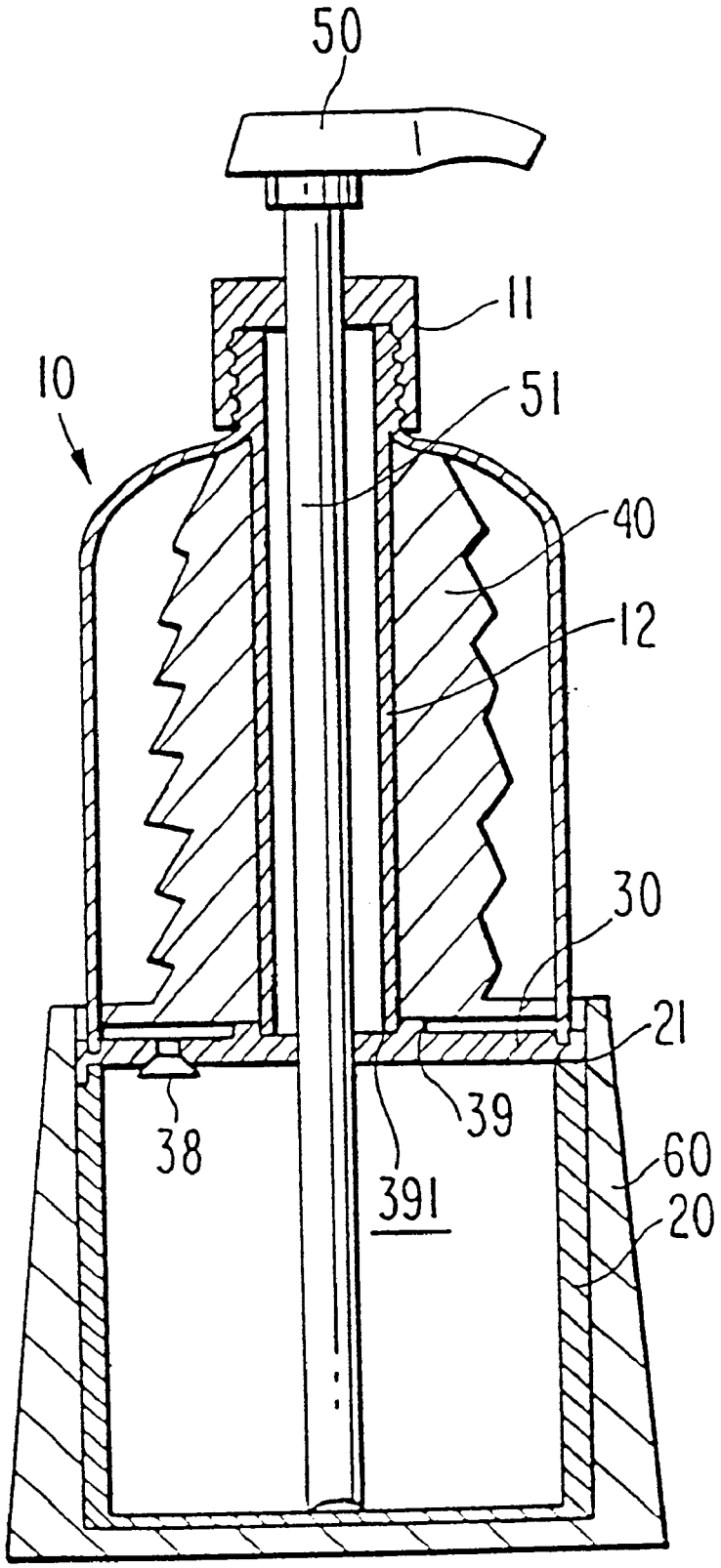
FIG. 12 is a partial sectional view of the second embodiment in accordance with the present invention.
Figure 13:
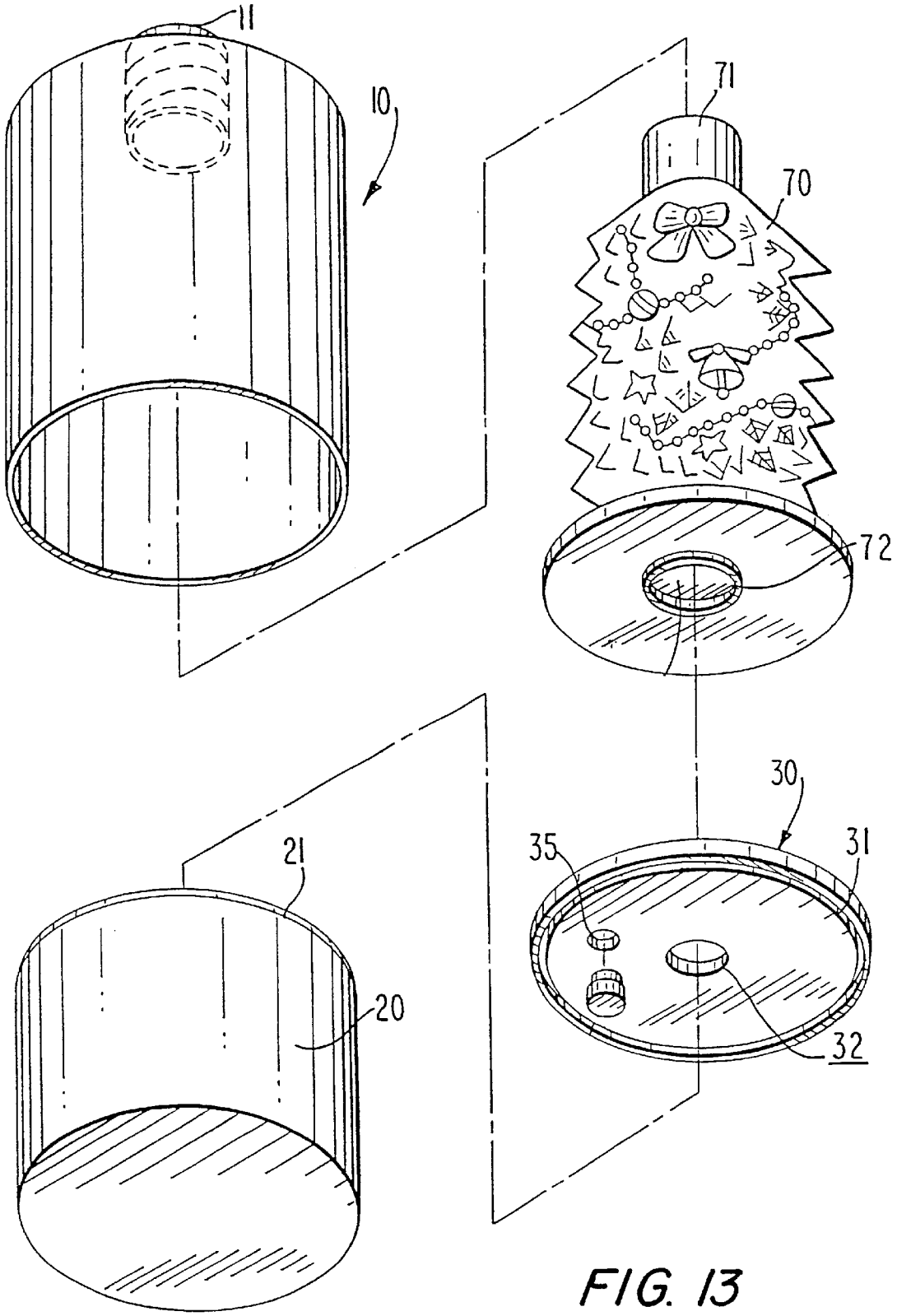
FIG. 13 is an exploded view of FIG. 9 in accordance with the present invention.
Figure 14:
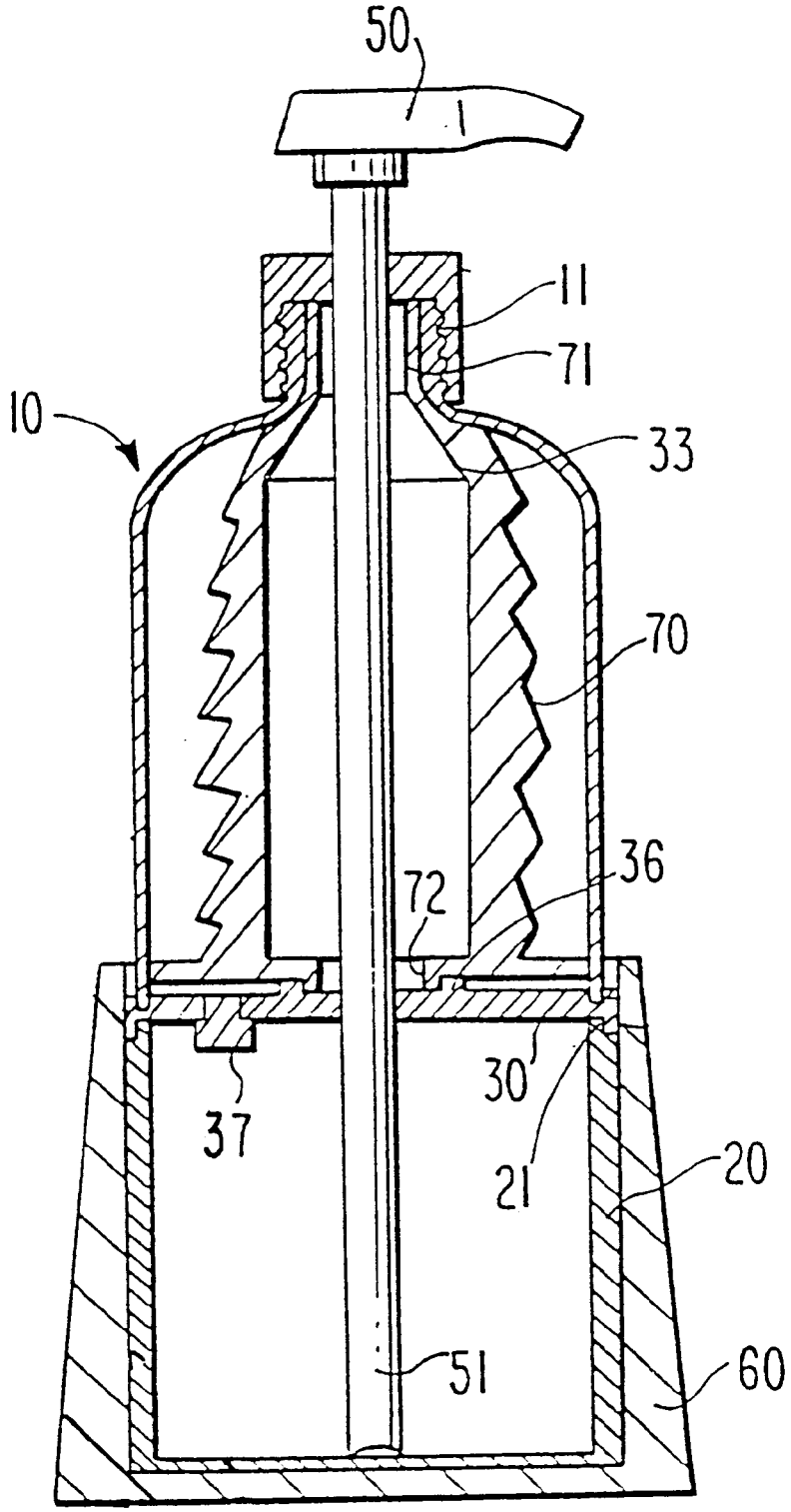
FIG. 14 is a partial sectional view of the third embodiment in accordance of the present invention.
Figure 15:
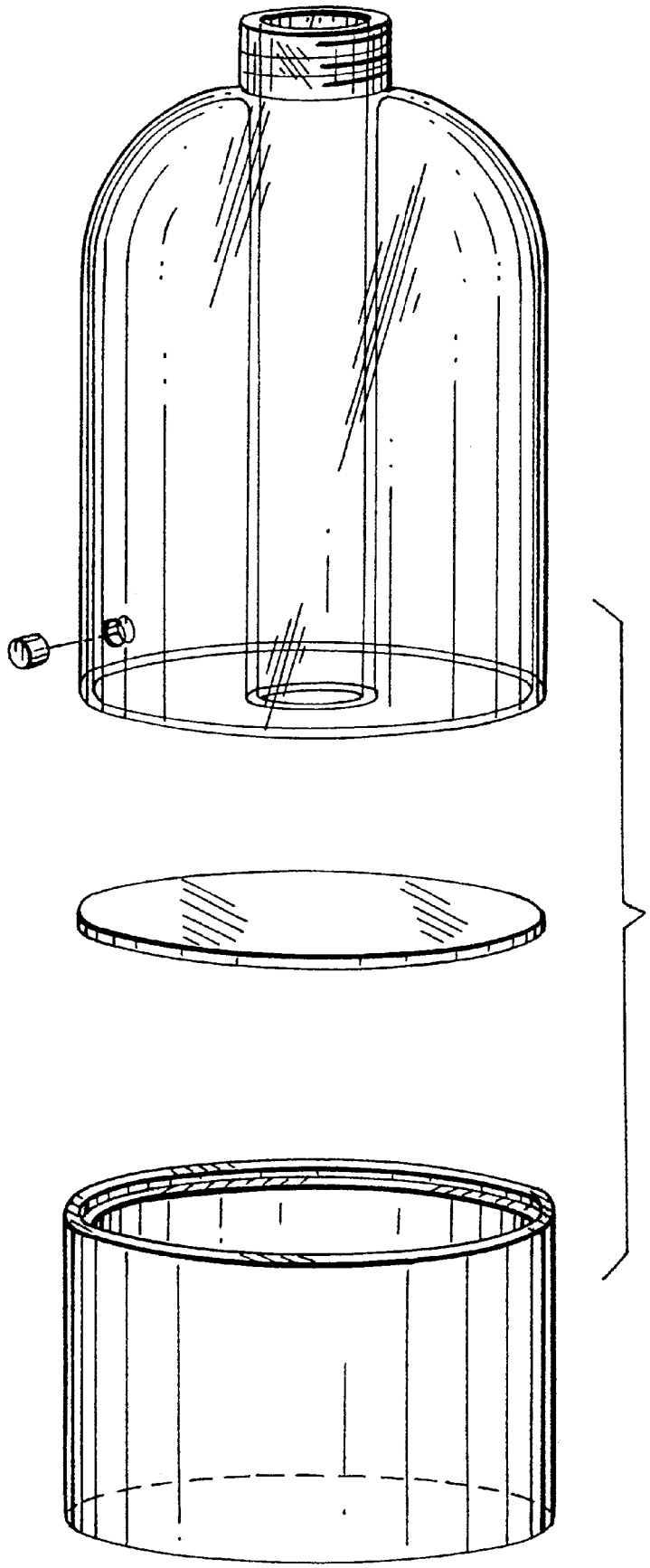
FIG. 15 is an exploded view of the fourth embodiment in accordance with the present invention.

Referring to FIGS. 5 and 6, FIG. 5 shows an exploded view of the various parts of the device in accordance with the second embodiment of the present invention wherein the tapered dispensing sleeve (13) is matingly fitted on the threaded member of the transparent hollow cavity (11); FIG. 6 shows a sectional view of the device in accordance with the second embodiment of the present invention, wherein FIG. 5 shows a second preferred embodiment which differs from FIG. 2 described supra. Particularly, with reference to transparent hollow cavity (1), the threaded member (11) of the transparent hollow cavity (1) extends downwardly through the transparent hollow cavity and the threaded member (11) includes the tapered dispensing sleeve (13) having a first end and a second end, wherein the threaded member (11) and the first end of the tapered dispensing sleeve (13) merge as one. In addition, in this second embodiment, the circular dividing board (2) and the circular disk (22) are two separate and independent entities merged as one, the first end of the circular disk (22) has a threaded opening (23) to receive the second end of the tapered dispensing sleeve (13) and to facilitate the threaded opening (23) to matingly fit with the second end of the tapered dispensing sleeve (13). The second end of the circular disk (24) has a diameter slightly larger than the first end of the circular disk (22) and provides a threaded threaded surface to facilitate the joining of the second end of the circular disk (24) with the second end of the transparent hollow cavity (1) in order to prevent liquid (a) and liquid (b) from seeping out and admixing with the cleansing solution placed in the reservoir (3). Except for the construction of the dispenser, the second embodiment performs the same function and achieves the same results as the first embodiment.

As can be realized from the above description, the dispenser according to the present invention overcomes the shortcomings of the existing prior art. The present invention has a novel and unique construction which, in addition to providing functionality, also is aesthetically pleasing and since it is refillable decreases the global non-biodegradable garbage. These characteristics fully satisfy the requirement of patent statutes; thus, the present application has been submitted in accordance with the patent law regulation, and early and favorable consideration of the present invention is earnestly solicited.

The present invention has been described above by way of examples, however, the embodiments described above in by no way limit the present invention since they are just illustrations of methods to practice the present invention. The scope of the present invention will be further defined by the claims of the present application.

What is claimed is:

1. A structure for a dispenser, comprising:

a transparent cavity which is hollow in the center, the cavity having a first end and a second end, wherein the first end has a threaded member, and a water intake opening positioned toward the second end of the cavity;

a circular dividing board comprising a circular disk fused with a tapered dispensing sleeve and having a threaded member, wherein the tapered dispensing sleeve penetrates through the center of the circular disk thus forming a passage to facilitate communication between the threaded member of the transparent cavity and a reservoir;

the reservoir has an interior surface, an exterior surface, a first end and a second end, wherein the interior surface is capable of holding cleansing solution and/or lotion and the first end of the reservoir is equipped with a threaded member to matingly fit and tightly seal with the threaded member of the circular dividing board which in turn merges with the transparent cavity to form one unit; and at least one decorative item placed within the transparent cavity, the transparent cavity further having a water intake opening to receive at least two different liquids with at least one coloring agent, using the differences in the density of water, oil and the decorative item to enable the decorative item to remain afloat on the surface of the water thus creating an aesthetically pleasing effect, an actuator connected to the threaded member of the transparent cavity, and a dispensing tube connected to the actuator and extending downwardly into the reservoir to withdraw the cleansing solution and lotion from the reservoir;

whereby a functional yet aesthetically pleasing dispenser that is environmentally sound is created.

2. The dispenser as claimed in claim 1, wherein the water intake opening can be sealed with a stopper and/or any conventionally available adhesive.

3. The dispenser as claimed in claim 1, wherein the threaded member atop the transparent cavity forms a vacuum tube which extends downwardly through the transparent cavity towards the circular dividing board, wherein the vacuum tube and the threaded member of the transparent cavity are one unit.

4. This dispenser as claim 3, wherein the circular dividing board and a circular disk are two independent structures merged together, the merged structure having an aperture in the center to receive a dispensing sleeve, the dispensing sleeve connecting the threaded member of the transparent cavity and the merged structure to form a tight seal, and the merged structure having a first end and a second end, wherein the second end has a diameter slighter larger than the first end, the second end having a threaded member to matingly fit with the second end of the transparent cavity in order to prevent the admixing of the human cleansing solution/lotion with the liquids disposed within the transparent cavity.

* * * * *